US007227968B2

(12) United States Patent
van Halteren et al.

(10) Patent No.: US 7,227,968 B2
(45) Date of Patent: Jun. 5, 2007

(54) EXPANDSIBLE RECEIVER MODULE

(75) Inventors: Aart Zeger van Halteren, Hobrede (NL); Martin Bondo Jørgensen, Smørum (DK); Karsten Videbæk, Roskilde (DK); Theodorus Gerardus Maria Brouwer, Heemstede (NL); Paulus Teun Spaanderman, Leiden (NL); Dennis Jacobus Mattheus Mocking, Utrecht (NL); Jeroen Pieter Johannes Augustijn, Leiden (NL)

(73) Assignee: Sonion Roskilde A/S, Roskilde (DK)

( * ) Notice: Subject to any disclaimer, the term of this patent is extended or adjusted under 35 U.S.C. 154(b) by 821 days.

(21) Appl. No.: 10/177,140

(22) Filed: Jun. 24, 2002

(65) Prior Publication Data

US 2002/0196958 A1 Dec. 26, 2002

(51) Int. Cl.
*H04R 25/00* (2006.01)

(52) U.S. Cl. ..... 381/328; 381/322; 381/324; 381/380

(58) Field of Classification Search ..... 381/60, 381/322, 324, 326, 327, 328, 380; 600/25; 607/56, 57; 181/128, 129, 130, 135; 128/864, 128/865

See application file for complete search history.

(56) References Cited

U.S. PATENT DOCUMENTS

| | | | | |
|---|---|---|---|---|
| 4,133,984 | A | 1/1979 | Akiyama | |
| 4,539,440 | A | 9/1985 | Sciarra | |
| 4,834,211 | A | 5/1989 | Bibby et al. | |
| 5,333,622 | A | 8/1994 | Casali et al. | |
| 5,338,287 | A | 8/1994 | Miller et al. | |
| 6,094,494 | A | 7/2000 | Haroldson | |
| 6,339,648 | B1 | 1/2002 | McIntosh et al. | 381/328 |
| 6,438,244 | B1 | 8/2002 | Juneau et al. | |
| 6,671,381 | B1 | 12/2003 | Lux-Wellenhof | |
| 2002/0114479 | A1 | 8/2002 | McIntoch et al. | 381/322 |
| 2004/0215053 | A1 * | 10/2004 | Jorgensen et al. | 600/25 |

FOREIGN PATENT DOCUMENTS

| | | |
|---|---|---|
| EP | 0855847 | 7/1998 |
| WO | WO 02/067626 A2 | 8/2002 |

* cited by examiner

*Primary Examiner*—Huyen Le
(74) *Attorney, Agent, or Firm*—Harness, Dickey & Pierce, P.L.C.

(57) ABSTRACT

The present invention relates to a receiver module being adapted to be positioned in an ear canal, the receiver module comprising a receiver having a receiver housing, said receiver being adapted to receive a time dependent electrical signal, said receiver further being adapted to generate outgoing acoustic waves via an output port in the receiver housing in response to the received time dependent electrical signal, and expansible means surrounding at least part of the receiver housing, said expansible means having an opening aligned with the output port of the receiver housing so as to allow the generated outgoing acoustic waves to penetrate away from the receiver module and into the ear canal.

15 Claims, 18 Drawing Sheets

EXPANDSIBLE RECEIVER MODULE

The present invention relates to expansible receiver modules. In particular, the present invention relates to expansible receiver modules for hearing aids. Such expansible receiver modules are suitable for being mounted within the bony area of the ear canal.

BACKGROUND OF THE INVENTION

Hearing aids today are typically manufactured in one piece—i.e. one component comprising all necessary sub-devices such as microphone, amplifier and receiver—the latter being used to generate a sound pressure so as to excite the eardrum in response to sound pressure captured by the microphone. The components—microphone, amplifier and receiver—are encapsulated in a common plastic shell as illustrated in FIG. 1.

Figure 1:
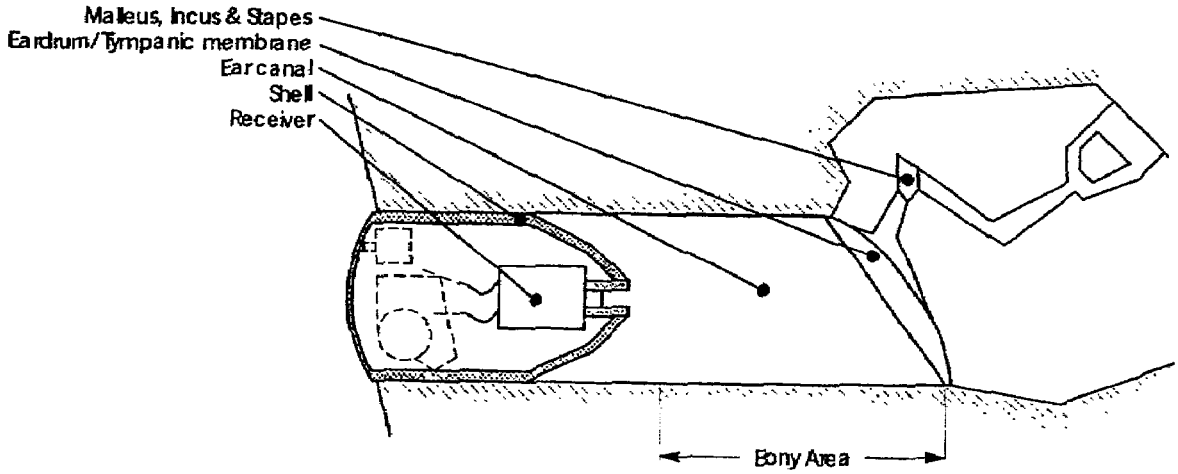
Fig. 1 (prior art)

As seen in FIG. 1, the hearing aid is positioned at a relatively large distance from the eardrum—in front of the bony area of the ear canal. The reason for this being that the plastic material forming the shell encapsulating the above-mentioned components is hard, which makes it impossible to position a conventional hearing aid with a plastic shell in the bony area of the ear canal without introducing pain to the user of the hearing aid.

Another disadvantage of one-piece hearing aids is the large distance between the receiver output and the eardrum to be excited.

Other disadvantages relating to one-piece hearing aid are acoustic feedback from the receiver to the microphone, vibrations of the receiver, which is transmitted to the ear canal, unpleasant for the user and finally the rather complicated and painful mounting of the hearing aid.

U.S. Pat. No. 6,094,494 discloses a device and a method for fitting a sound transmission device to provide an easy and effective fit, reduce feedback, and improve user comfort comprises an ear-piece component having a face at one end with operative components and a stem adjacent the other end. The stem houses a speaker tube which protrudes from the component, and it has a retaining means for securing an inflatable, resilient fitting balloon thereon. The balloon has a sound transmission duct within it which can be coupled to the speaker tube so that when the balloon is secured to the stem, a continuous path is provided for the transmission of sound from the component to the user's ear canal external the balloon. This assembly (e.g., the component and attached balloon) is inserted into the ear canal when the balloon is in a deflated configuration. Air is then pumped into the balloon, e.g., through an air channel in the ear-piece component, to inflate the fitting balloon. The inflated fitting balloon engages the ear-piece component against the walls of the user's ear canal and prevents sound from travelling to the external ear and face of the component.

U.S. Pat. No. 4,133,984 discloses a plug-type hearing device comprising a sound-leading portion being inserted into the auditory miatus, a first envelope attached around the sound-leading portion, a second envelope being positioned at the outside of the auditory miatus and being communicated with the first envelope through a pipe, and a holding means for holding an expanded state of the first envelope when the volume of the latter is increased, wherein the volume of the second envelope is decreased to increase the volume of the first envelope by the pressure of a fluid contained inside, and the expanded first envelope is closely contacted with the wall surface of the auditory miatus.

However, the balloon introduced in U.S. Pat. Nos. 6,094,494 and 4,133,984 does not solve the above-mentioned problems in that the hearing aid is still a one-piece device—the only difference compared to the hearing aid of FIG. 1 is that a flexible sound-leading portion has been attached to the hearing aid in order to guide sound from the receiver, which is still positioned at a large distance from the eardrum, to an opening near the inner end of the flexible sound-leading portion.

Thus, problems related to the large distance between the receiver output and the eardrum is not solved by the set-ups suggested in U.S. Pat. No. 6,094,494 and 4,133,984. Even further, since the systems of U.S. Pat. No. 6,094,494 and 4,133,984 are still one-piece hearing aids problems such as acoustic feedback from the receiver to the microphone, vibrations of the receiver, which is transmitted to the ear canal, are still present and may easily influence the performance of the hearing aid in a negative direction.

It is an object of the present invention to provide an external receiver module, which solves the above-mentioned problems. The external receiver module according to the present invention has the following advantages:

- The receiver may be brought close to the eardrum (in the bony area).
- Using an expansible, preferably inflatable, medium to keep the receiver in its place instead of a plastic shell.
- Dividing the conventional one-piece hearing aid into two parts connected by a tube.
- That part of the hearing aid comprising the microphone may be removed—e.g. for repair—without removing the receiver module from the ear canal.
- No problem with cerumen.
- No acoustic feedback to the microphone.
- No occlusion effect.
- The expansible medium may be expanded to the user's wishes (comfort).
- Easy to fit in the ear.
- The expansible medium is soft which is of importance in the bony area.
- No vibration transfers from the receiver to the ear canal.
- The receiver module including the expansible medium may be removed and cleaned without surgery by the audiologist.

SUMMARY OF THE INVENTION

The above-mentioned object is complied with, and the above-mentioned advantages are achieved, by providing, in a first aspect of the present invention a receiver module being adapted to be positioned in an ear canal, the receiver module comprising

- a receiver having a receiver housing, said receiver being adapted to receive a time dependent electrical signal, said receiver further being adapted to generate outgoing acoustic waves via an output port in the receiver housing in response to the received time dependent electrical signal, and
- expansible means surrounding at least part of the receiver housing, said expansible means having an opening aligned with the output port of the receiver housing so as to allow the generated outgoing acoustic waves to penetrate away from the receiver module and into the ear canal.

The expansible means is preferably inflatable means, which may be a balloon-like device, which may be inflated with air, liquids, gel or foam or the like. In order to inflate the balloon-like device, air or liquid may be pumped into the balloon-like device. The balloon-like device may be fabricated in a flexible material such as latex, silicone or any other elastomer. The material may be chosen so as to provide a permeable inflatable means so that a medium being held inside the inflatable means may penetrate the material forming the inflatable means so as to enter the bony area of the ear canal.

Figure 17:
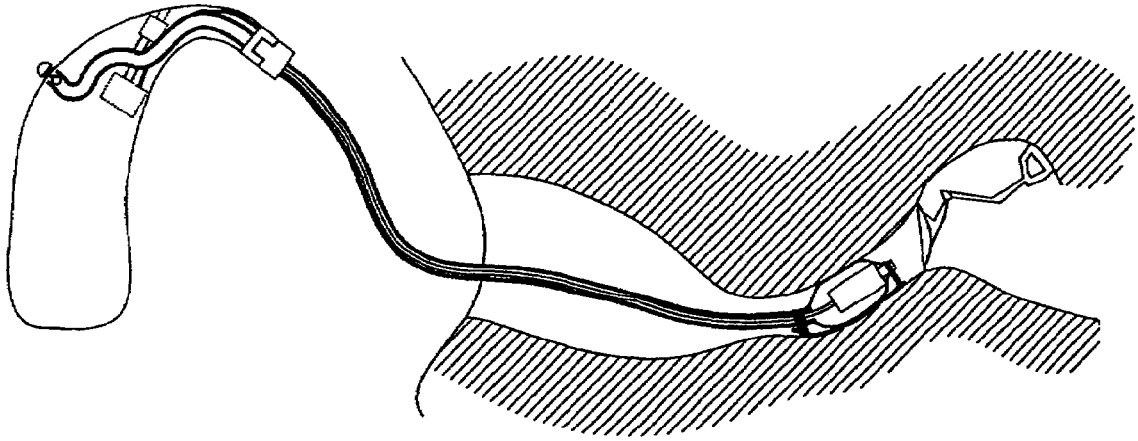

Alternatively, the expansible means may be mechanically expansible means, which may be expanded in the ear canal. Such a mechanical arrangement may be an umbrella-like system such as shown in FIG. 17.

The inflatable means may also be a balloon-like device filled with some sort of elastic foam. The dimensions/volume of such balloon-like device may be controlled by controlling the amount of air in the foam. For example, the volume of the balloon-like device may be reduced by pumping air out of the foam whereby the balloon-like device may be brought into its final position—e.g. its final position in an ear canal. The pump may then be disconnected, and the foam will now be filled/or at least partly filled with air whereby its dimensions will increase so as to fit the dimensions of the ear canal. The expansible means may be made of a sponge-like material, so that it is self-expansible (e.g. similar to the known self-expansible ear plugs).

The receiver module may further comprise a tube section having first and second end parts, the first end part being connected to the expansible means and/or the receiver. The tube section may be adapted to provide to the inflatable means a medium to inflate the inflatable means. This medium may be water, saltwater, glycerine, or silicone oil. Preferably, the tube section comprises a hollow inner section, said hollow inner section being adapted support electrical means for providing the electrical signal to the receiver. These electrical means may be electrical wires or the like. The tube section is preferably formed as a one-piece component with the inflatable means. In this situation, the tube/inflatable means may be fabricated as a single flexible tube having at least two sections with different diameters—one diameter being larger than the other. The integrated tube/inflatable means may then be provided by pulling the section having the smallest diameter into the section having the larger diameter, whereby a hollow tube with "integrated" inflatable means may be established.

The second end part of the tube section may be connected to a connection terminal, said connection terminal having electrical contacts connected to the electrical means supported by the inner section of the tube section. The connection terminal may comprise means for handling the medium for inflating the inflatable means.

Preferably, the connection terminal is a socket having electrical terminals for connecting the receiver to external electronic devices in terms of power, electrical signals representing amplified sound pressure etc. Such external electronic devices may be that part of a hearing aid comprising the microphone and the amplifier. The handling means for handling the medium for inflating the inflatable means may be some sort of canal in which the medium may flow. The canal will typically be combined with some kind of closing or switch.

The receiver module may further comprise a filter positioned in the opening of the expansible mean so as to cover the output port of the receiver housing. Alternatively, the receiver module may comprise a membrane positioned in the opening of the expansible mean so as to cover the output port of the receiver housing in order to protect the receiver against cerumen.

The receiver module may further comprise pump means for providing the medium to inflate the inflatable means to the inflatable means. As already mentioned this medium may be air, liquids, gel or the like. This pump means may be driven electrically or mechanically. In one embodiment, the receiver of the receiver module may act as the pump for inflating the inflatable means. The pump means may be controlled by activating an external string. By external is meant that the string is accessible for e.g. the user of the receiver module—e.g. accessible from the outside of the ear. Activation may be achieved by rotating, bending, pulling and/or pushing the string relative to the receiver module, whereby the pump means may be switched on and/or off. Even further, by activating the string the pressure in the inflatable means may be adjusted. Finally, the string may be used to remove the receiver module from the ear canal—simply by pulling the string.

Figure 13:
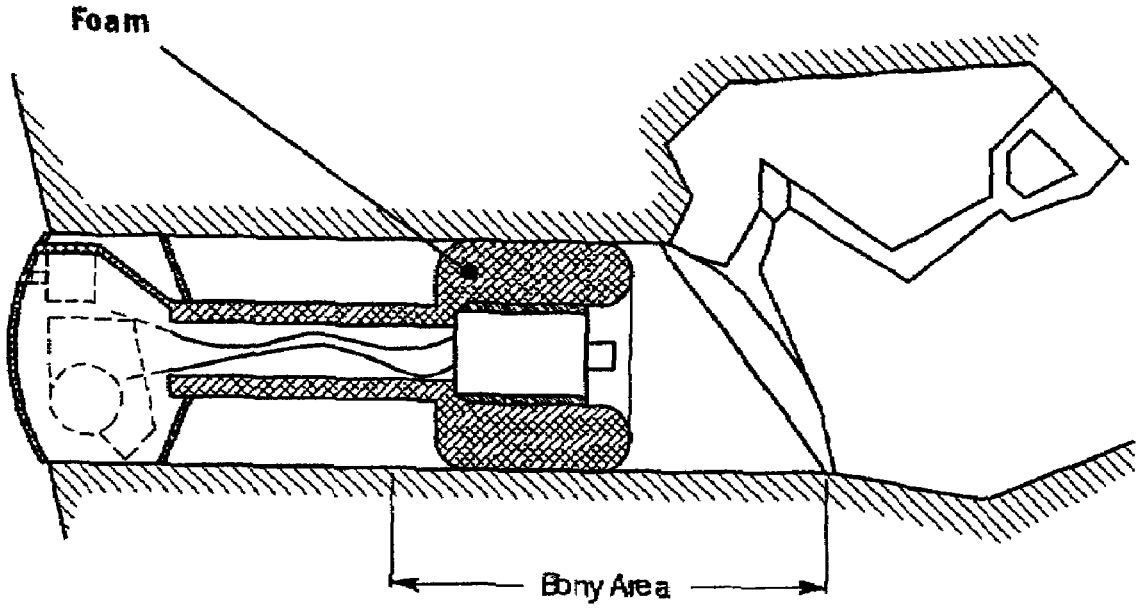

The receiver may be connected to the inflatable means, so that the back volume of the receiver is used for inflating the inflatable means. This back volume may act as a reservoir for housing the medium to be pumped into the inflatable means when the receiver module is to be positioned in the ear canal. When the receiver module is to be removed from the ear canal, the medium is pumped back into the back volume. Further, the tube section may be used as an extra back volume, and in that case the second end of it will be closed, as shown in FIG. 13.

The receiver module may further comprise a vent canal, said vent canal forming part of the inflatable means and the tube section so as to establish an unbroken vent canal from the second end part of the tube section to a point adjacent to the opening of the inflatable means. This vent canal is used to avoid occlusion and to equalise pressure between the area between the receiver module and the eardrum, and the outside. The vent canal may be provided/established by folding the inflatable means in a predetermined way so that parts of the folded areas define the vent canal.

In a second aspect, the present invention relates to a receiver module being adapted to be positioned in an ear canal, the receiver module comprising

- a flexible membrane having predetermined magnetic properties within a predetermined region of the membrane,
- expansible means having an opening holding the membrane,
- a tube section having first and second end parts, the first end part being connected to the expansible means, and
- means for generating a magnetic field in response to a provided time dependent electrical signal, the generated magnetic field displacing the flexible membrane in accordance with the provided time dependent electrical signal so as to generate outgoing acoustic waves which penetrate away from the flexible membrane and into the ear canal.

Again, the expansible means is preferably inflatable means, which may be a balloon-like device, which may be inflated with air, liquids, gel or the like. In order to inflate the balloon-like device, air or liquid may be pumped into the balloon-like device. Alternatively, the expansible means may be mechanically expansible means, which may be expanded in the ear canal, like the system shown in FIG. 16. The tube section may be adapted to provide to the inflatable means a medium to inflate the inflatable means.

The receiver module may further comprise a vent canal, said vent canal forming part of the inflatable means and the tube section so as to establish an unbroken vent canal from the second end part of the tube section to a point adjacent to the opening of the inflatable means. This vent canal is used to avoid occlusion and to equalise pressure between the area between the receiver module and the eardrum, and the outside.

The expansible means may be as describes in relation to the first aspect of the present invention. The same holds for the suggested media for inflating the inflatable means.

The predetermined magnetic properties may be determined by a magnet attached to the membrane. Alternatively, the predetermined magnetic properties may be determined by the membrane itself in case the membrane is magnetised by a magnetic material. The magnetisation may be provided by doping the membrane with a magnetic material such as iron. The magnetic field may be generated by means of a coil of wounded wire.

In a third aspect, the present invention relates to a receiver module being adapted to be positioned in an ear canal, the receiver module comprising

- a flexible membrane having predetermined magnetic properties within a predetermined region of the membrane,
- expansible means having an opening holding the membrane,
- a tube section having first and second end parts, the first end part being connected to the expansible means, and
- driving means for driving the flexible membrane in response to a time dependent electrical signal provided to the driving means so as to generate outgoing acoustic waves in accordance with the time dependent electrical signal.

Similar to the first and second aspects, the expansible means is preferably inflatable means, which may be a balloon-like device, which may be inflated with air, liquids, gel or the like. In order to inflate the balloon-like device, air or liquid may be pumped into the balloon-like device using pump means. Alternatively, the expansible means may be mechanically expansible means (e.g. an umbrella-like opening system or a sponge-like material), which may be expanded in the ear canal, like the system shown in FIG. 16. The tube section may be adapted to provide to the inflatable means a medium to inflate the inflatable means.

The expansible means may be as previously described in relation to the first and second aspect of the present invention. The same holds for the suggested media for inflating the inflatable means (air, a gel, a foam, or a liquid) and the preferred implementation of the vent canal—i.e. an unbroken vent canal from the second end part of the tube section to a point adjacent to the opening of the inflatable means. The driving means may comprise piezo-electrical materials. Alternatively, the driving means may comprise a flexible polymeric charged film or magnetostrictive materials.

The second end part of the tube section may be connected to a connection terminal, said connection terminal having electrical contacts connected to electrical means for providing the time dependent electrical signal to the receiver. The connection terminal may comprise means for handling the medium for inflating the inflatable means.

The receiver may be connected to the inflatable means so that a back volume of the receiver inflates the inflatable means upon providing a pressure the back volume of the receiver. The receiver may further comprise a layer of soft and flexible material surrounding the expansible means. This soft and flexible material will, when the receiver module is positioned in the ear canal, be positioned between the bony area of the ear canal and the expansible means.

It may be advantageous to shape the expansible means in a way so that, in a cross-sectional profile, the expansible means takes an elliptically shaped profile.

In a fourth aspect, the present invention relates to a hearing aid comprising a receiver module according to any of the preceding aspects. The hearing aid may in principle be any type of hearing aid, but it is preferably selected from the group consisting of BTE, ITE, ITC or CIC.

In relation to the first, second, third, and fourth aspects, the electrical signal may e.g. represent incoming acoustic waves and/or electromagnetic waves. The source providing the waves may e.g. be synthetic speech or music e.g. generated by a computer or it could be normal regular speech. Thus, beside hearing aids, the receiver module may be used in head-sets, headphones, ALDs and of course hearing instruments.

It should be understood that, though the present invention relates to a number of independent aspects, any combination of these aspects is possible within the scope of the present document.

BRIEF DESCRIPTION OF THE INVENTION

Figure 2:
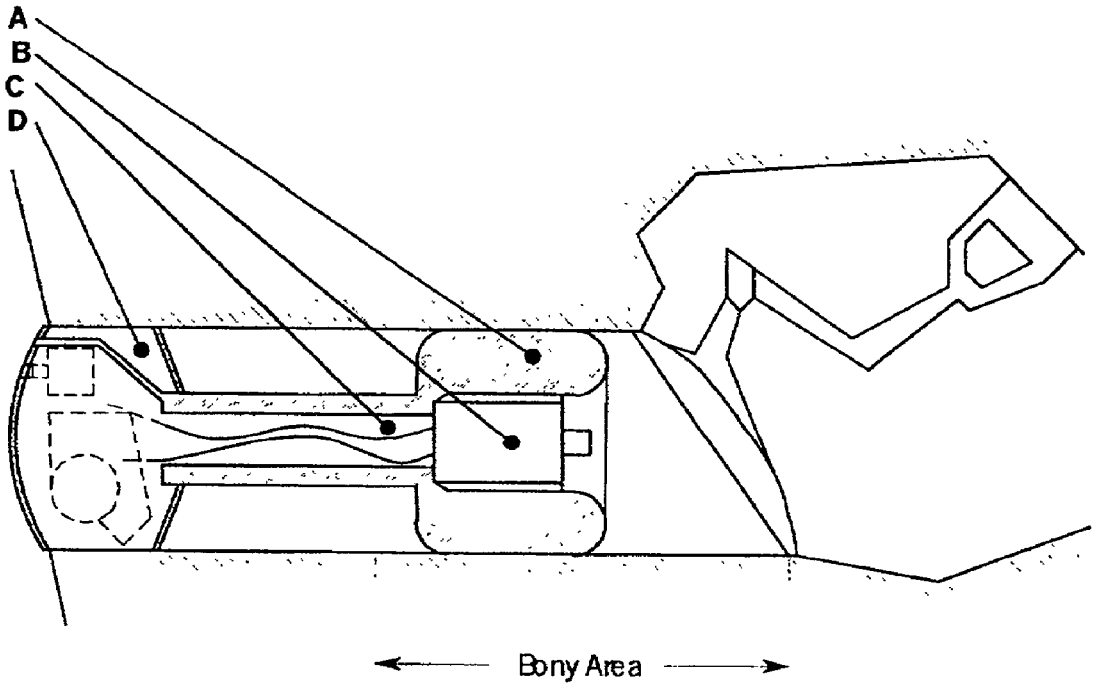
Figure 3:
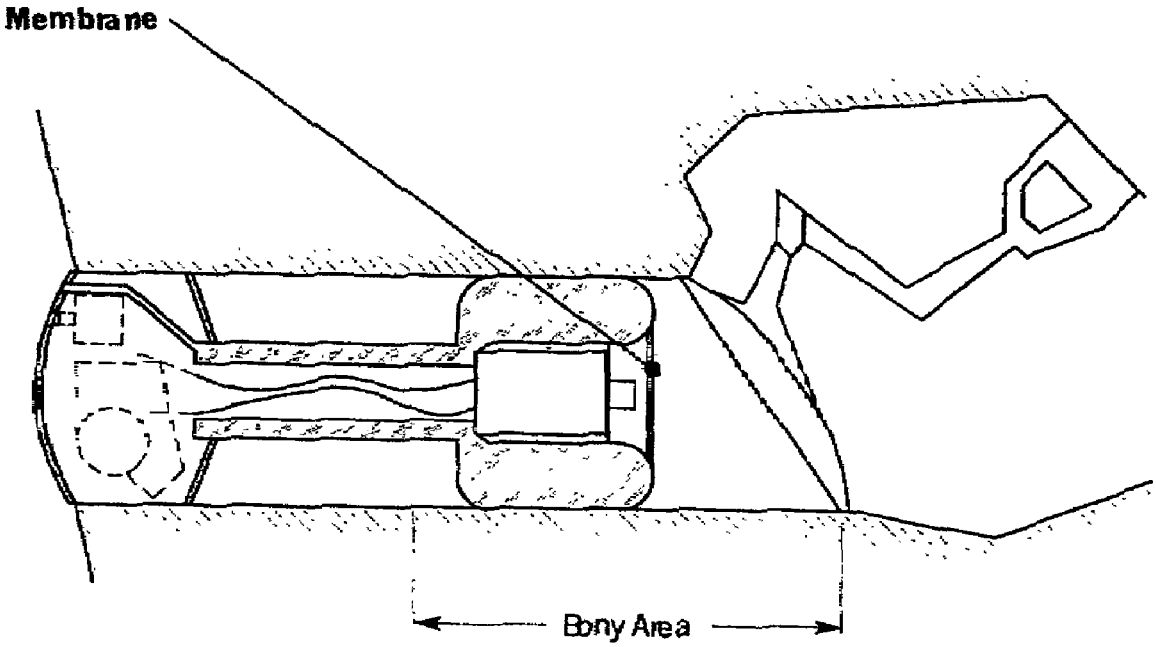
Figure 4:
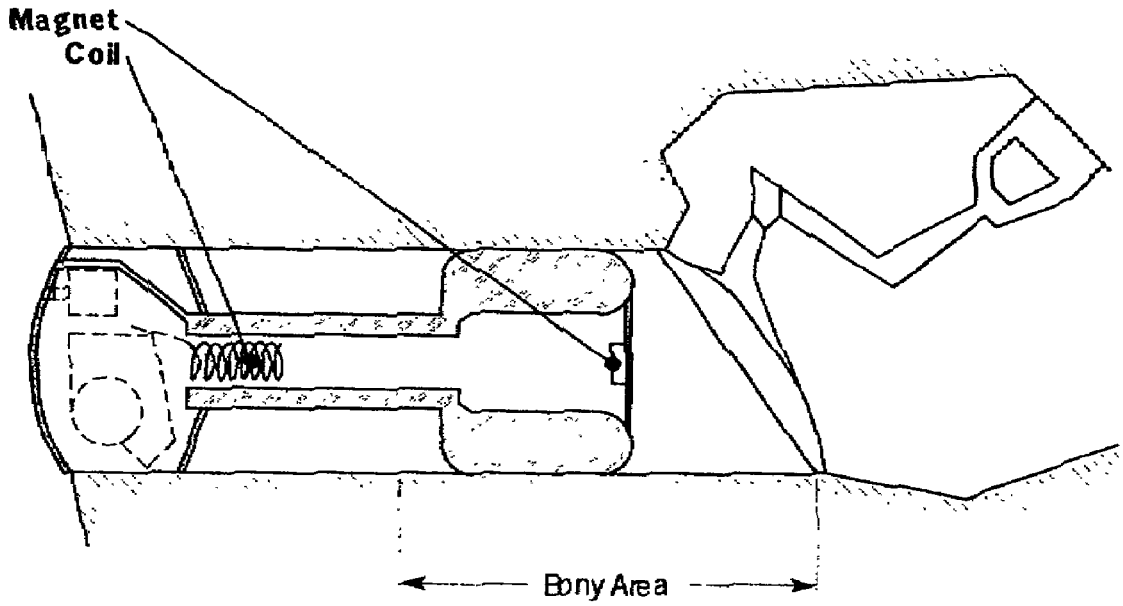
Figure 5:
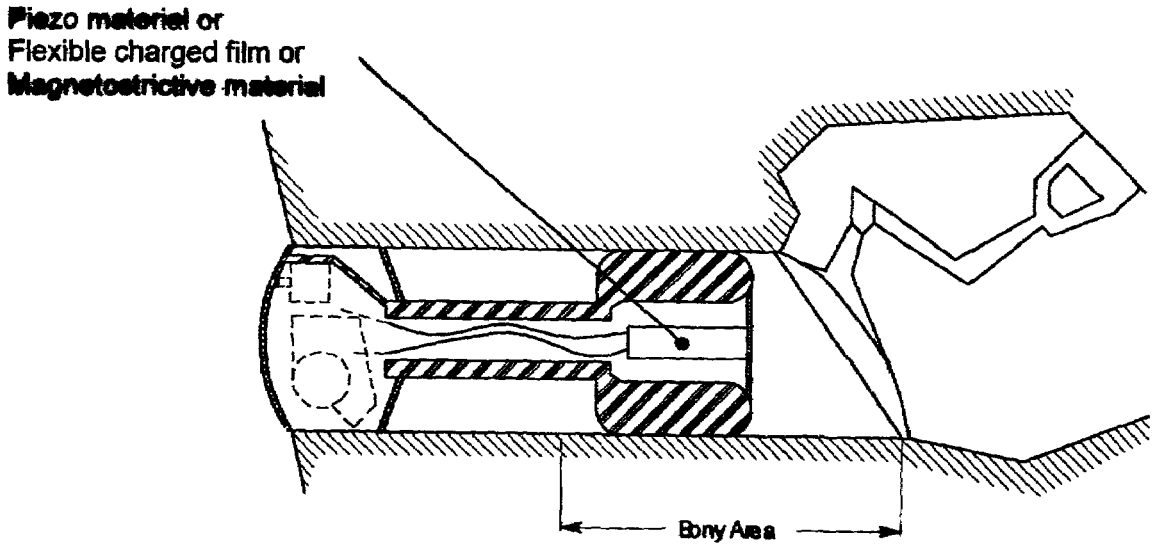
Figure 6:
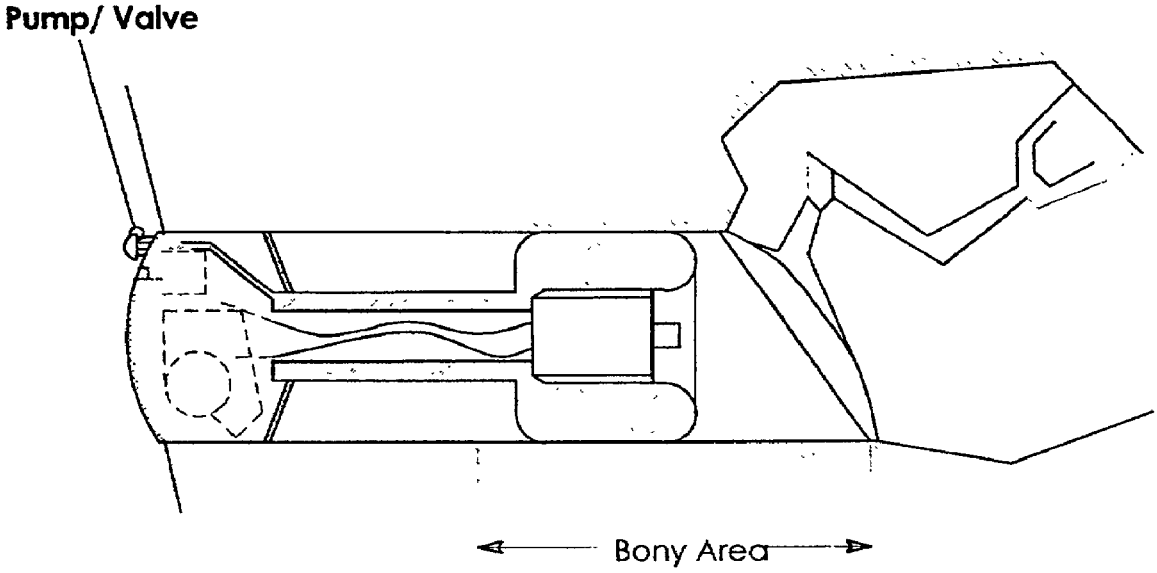
Figure 7:
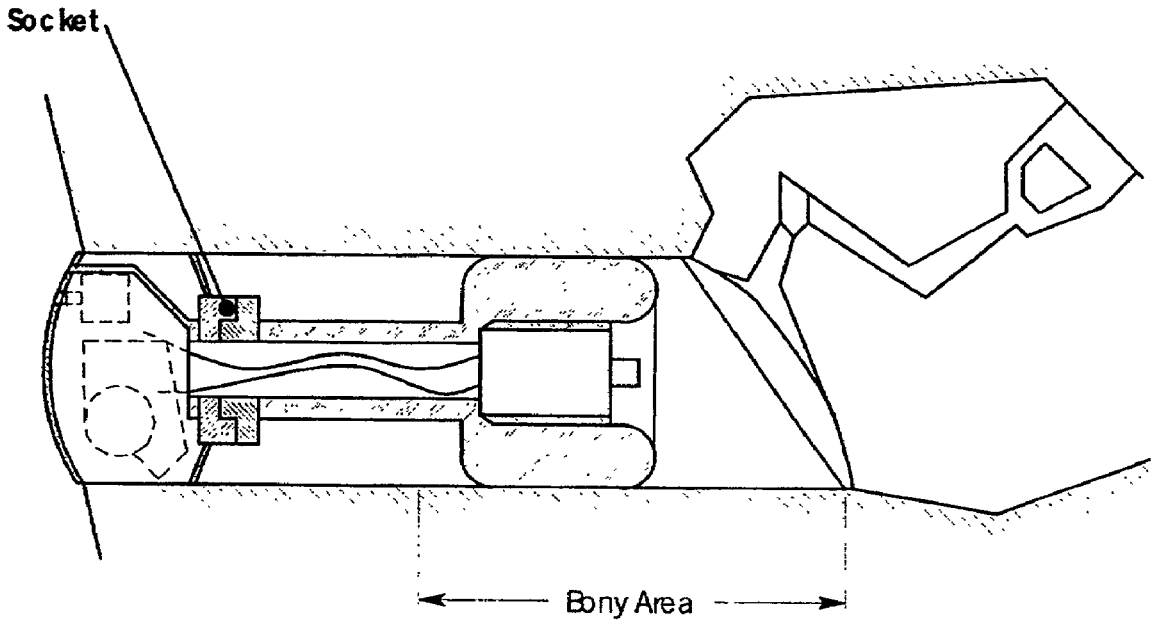
Figure 8:
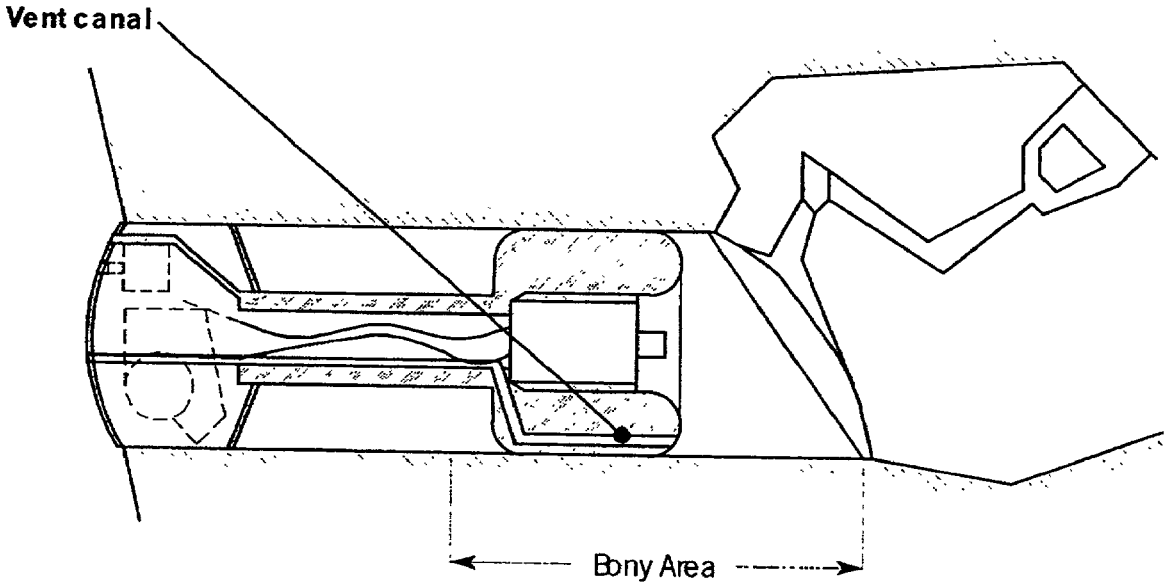
Figure 9:
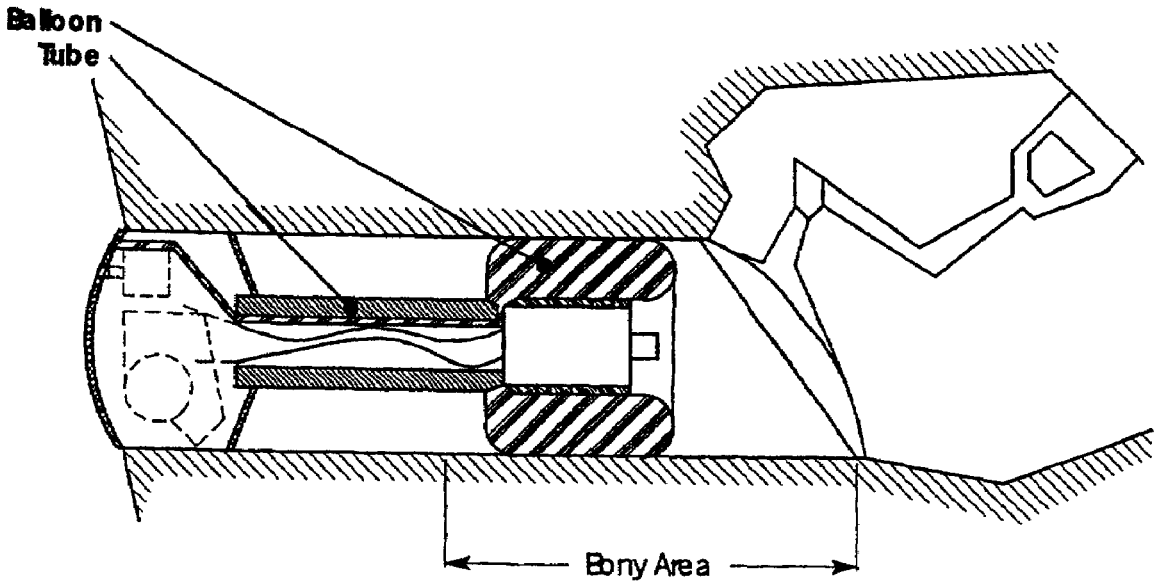
Figure 10:
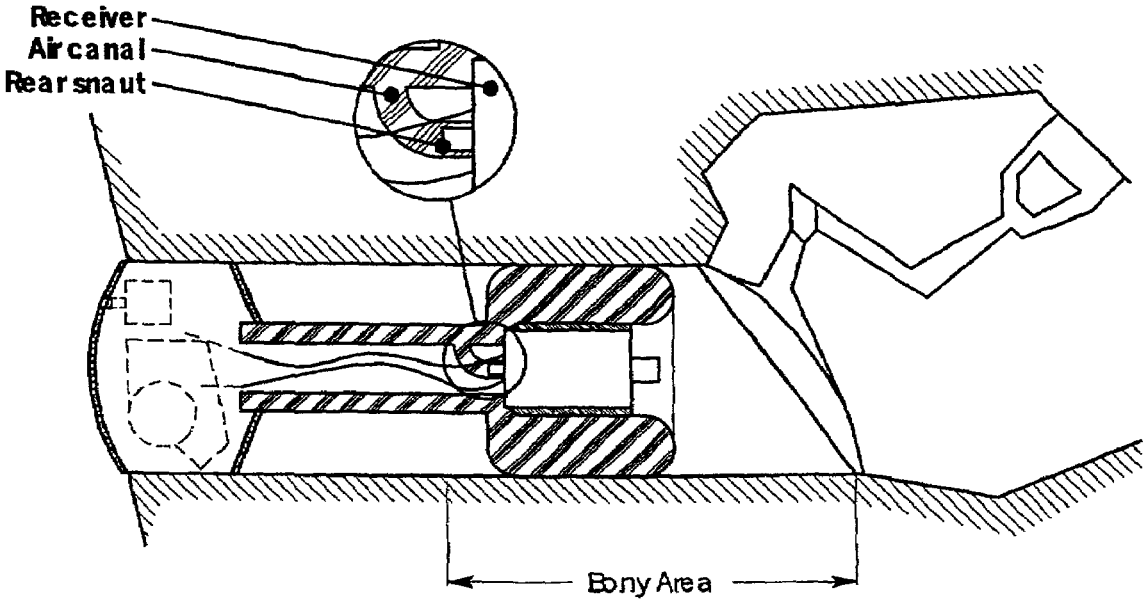
Figure 11:
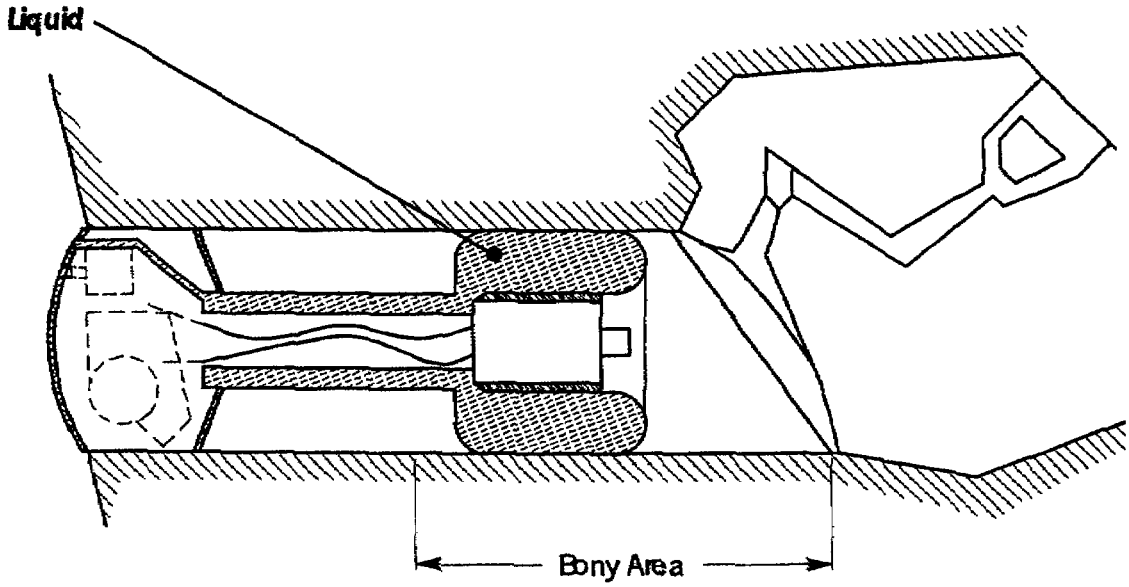
Figure 12:
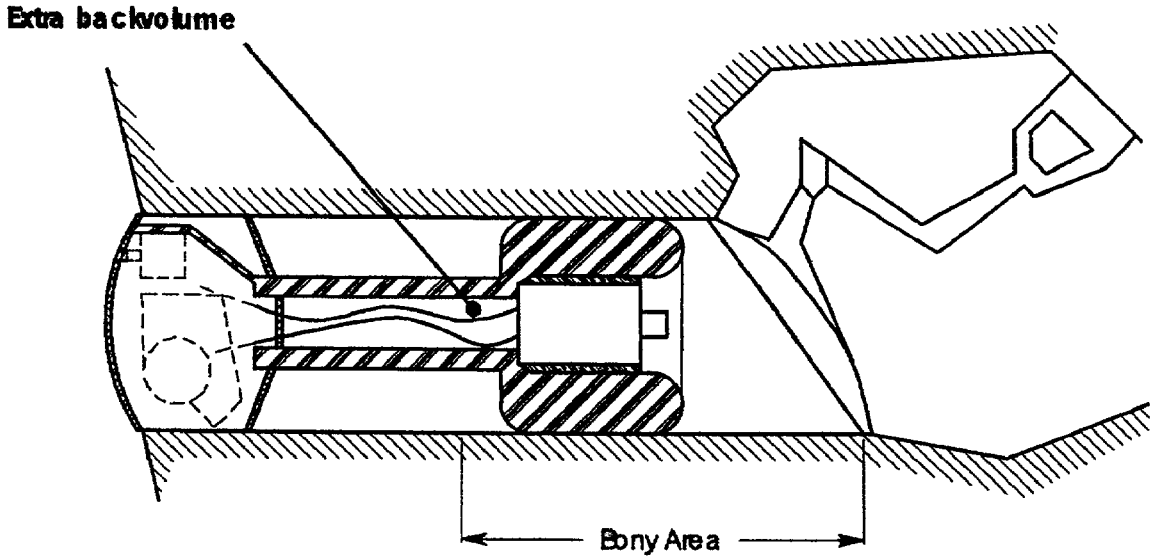
Figure 14:
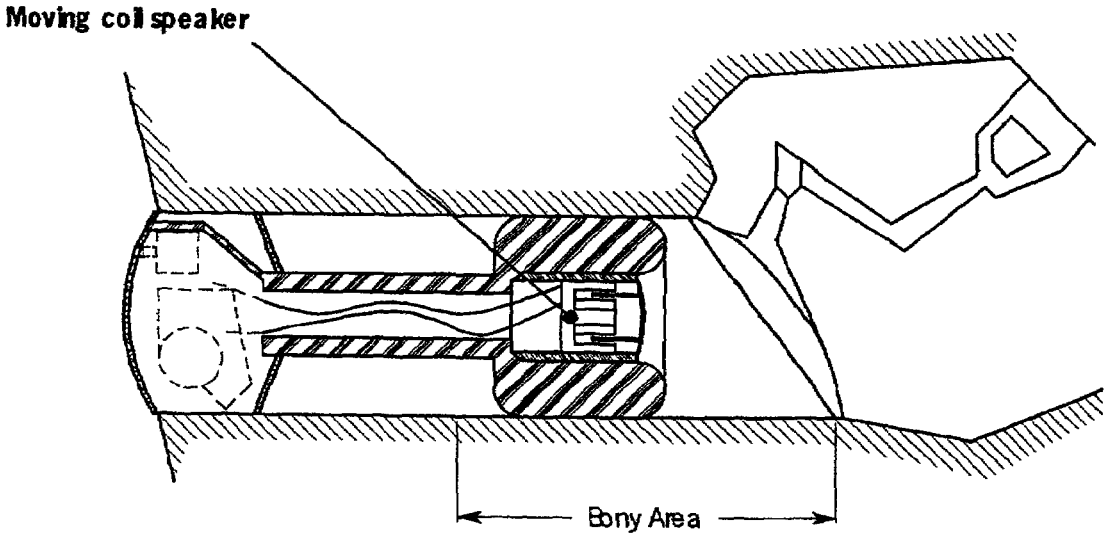
Figure 15:
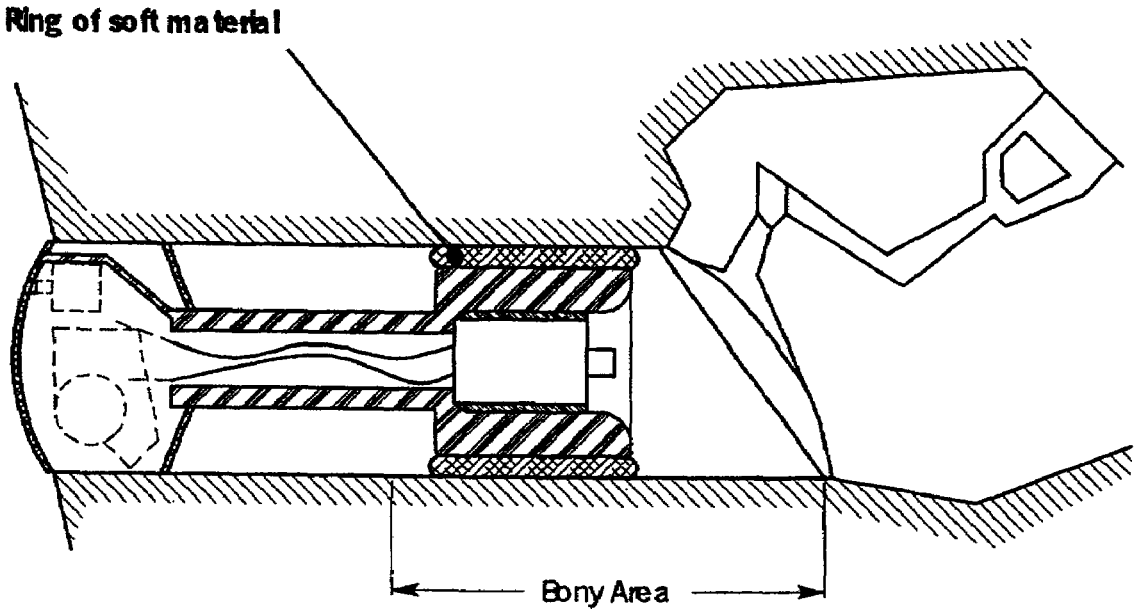
Figure 16:
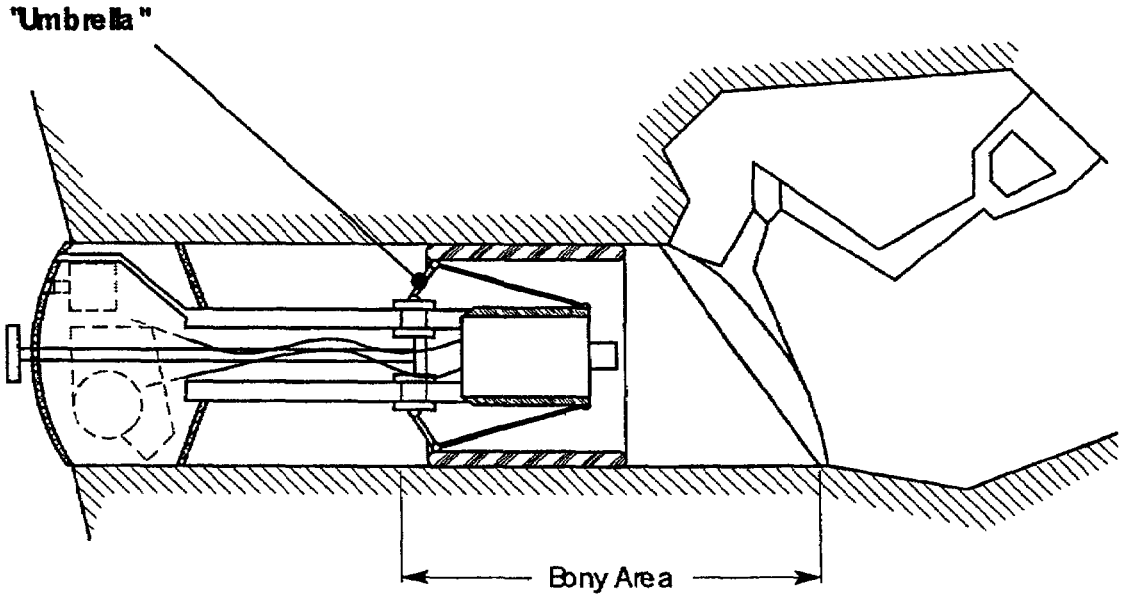
Figure 18:
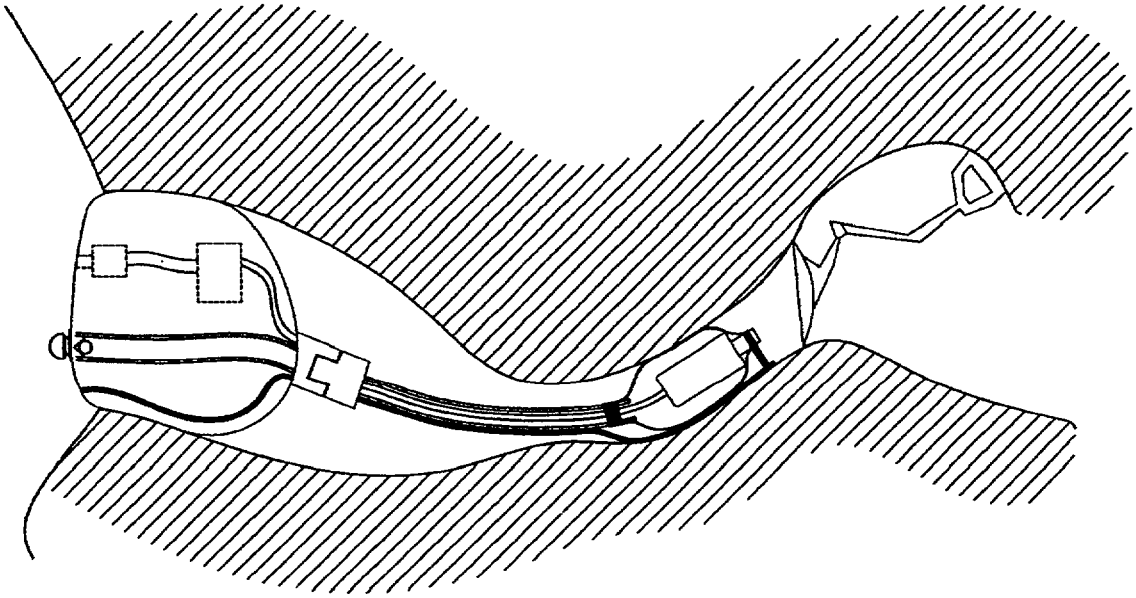

The present invention will now be described in further details with reference to the accompanying figures, where FIG. 1 shows a conventional hearing aid arrangement, FIG. 2 shows the general principle behind the present invention where a normal receiver B is partly surrounded by flexible member A which is connected by tube section C to hearing aid D. The flexible member—e.g. a balloon—is connected to the outside and can there be inflated with some kind of small pump, FIG. 3 shows a membrane attached to the balloon as a cerumen filter, FIG. 4 shows that the membrane may be driven by a magnet attached to the membrane, the coil generates the required magnetic field, FIG. 5 shows an alternative to the embodiment of FIG. 4, the membrane is now driven by another type of driver (piezo, a flexible polymeric charged film, magnetostrictive, etc), FIG. 6 shows an embodiment including a pump for pumping air, liquid or gel in or out of the flexible member, FIG. 7 shows an arrangement where the receiver and flexible member is attaching to the hearing via a socket whereby the two parts (receiver with flexible member and hearing) may be easily disconnected and reconnected again, FIG. 8 shows an arrangement including a vent canal so as to avoid occlusion, FIG. 9 shows an arrangement where the tube and balloon are of a different material, FIG. 10 shows an arrangement where an extra snout is added so that the back volume of the receiver works as a pump for blowing up the balloon, FIG. 11 shows an arrangement where the balloon is filled with a liquid, FIG. 12 shows an arrangement where a hole is provided in the receiver in order to connect the receiver back volume with the volume of the tube, FIG. 13 shows an arrangement where the balloon is filled with foam, FIG. 14 shows an arrangement where a moving coil is used as receiver, FIG. 15 shows an arrangement where a ring of soft material is put around the balloon, FIG. 16 shows an arrangement where the expansible means comprises a mechanically "umbrella-like" system shows as to expand the expansible means mechanically, FIG. 17 shows the present invention applied in connection with a BTE hearing aid, and FIG. 18 shows the present invention applied in connection with a ITE hearing aid.

DETAILED DESCRIPTION OF THE INVENTION

The main aspect of the present invention is illustrated in FIG. 2 where receiver B is at least partly surrounded by inflatable means A (e.g. balloon) which is connected to hearing aid D via tube section C. Inflatable medium A is connected to the outside and can be inflated using some kind of pump.

Inflatable means A could be a balloon which, after being inserted in the ear canal, is inflated with air, liquids, gel or the like. An external pump is used to inflate the balloon. Preferably, the pump may be controlled by the user so that the user may adjust the pressure in the balloon so as obtain maximum comfort.

In an alternative embodiment, the inflatable means can also be a flexible member filled with some sort of elastic foam. The dimensions/volume of this flexible member can be controlled by controlling the amount of air in the foam. For example, the volume of the flexible member can be reduced by pumping air out of the foam whereby the flexible member can be brought into its final position in the ear canal. At its final position air will be provided to the foam causing the foam to expand so as to fill up the area between receiver B and the ear canal as shown in FIG. 2.

The receiver module is connected to hearing aid D via tube section C. Hearing aid D typically comprises a microphone and an amplifier to amplify electrical signals generated by the microphone. The amplified signals are provided via tube section C to receiver B.

In a preferred embodiment, tube section C has first and second end parts, the first end part being connected to inflatable means A. Tube section C is also adapted to provide to inflatable means A the medium to inflate the inflatable means (air, liquid, gel or the like). Preferable, tube section C comprises a hollow inner section for carrying electrical wires from hearing aid D to receiver B.

FIG. 3 shows a similar system as shown in FIG. 2 now with a membrane positioned in front of the receiver. This membrane acts as a filter against cerumen and thereby protects the receiver.

FIGS. 4 and 5 show alternative embodiments of the present invention. In FIG. 4 the membrane has predetermined magnetic properties determined by a magnet attached directly to the membrane. Alternatively, the predetermined magnetic properties can be achieved by doping the membrane—e.g. during manufacturing—with a magnetic material. In FIG. 4, the membrane is driven by a coil electrically connected to the hearing aid. In FIG. 5, the membrane is driven by some sort of driver—e.g. a driver comprising piezo-electric, a flexible polymeric charged film or magnetostrictive materials.

In FIG. 6, a pump has been added to the embodiment shown in FIG. 3. The pump is adapted to provide to the inflatable means the medium for inflating said means. As already mentioned, this medium could be air, liquid or gel or the like. The pump can also be used to empty the inflatable means and thereby reduce the volume of the in flatable means. Alternatively, the pump can be used to pump air out of a foam-filled flexible member so as to reduce the volume of the flexible member constituting the inflatable means. The pump can be operated either mechanically or electrically. In case of an electrical pump, the receiver of the receiver module can act as a small pump for inflating/emptying the inflatable means/foam-filled flexible member.

In FIG. 7, the second end part of tube section C is connected to a socket having electrical terminals for connecting the receiver to the hearing aid via electrical terminals in the socket. Power signals and electrical signals representing amplified sound pressure or the like can be exchanged across the socket between the hearing aid and the receiver. Preferably, the socket also comprises handling means for handling the medium for inflating the inflatable means. This can be in form of a canal in which the medium is guided. The canal will typically be combined with some kind of closing or switch so that the medium remains within the tube section in case the socket is removed from the hearing aid.

The receiver module can also include a vent canal—see FIG. 8. Preferably, the vent canal forms part of the inflatable means and the tube section so as to establish an unbroken vent canal from the second end part of the tube section to a point adjacent to the opening of the inflatable means. This vent canal is used to avoid occlusion and to equalise pressure between the area between the receiver module and the eardrum, and the outside.

FIG. 9 shows an arrangement almost similar to that of FIG. 3, but wherein the tube and balloon is made of different materials.

In FIG. 10, an extra snout is added to the receiver so that the back volume of the receiver may work as a pump for blowing up the balloon. Thus, this embodiment does not require a separate pump. The rear snout of the receiver is connected to the air canal.

FIG. 11 shows an arrangement where the balloon is filled with a liquid instead of air. The balloon may be filled with both air and liquid. Alternatively or additionally, the balloon may inflate itself from a vacuum (or lower pressure) position. Thus, in order to remove the hearing aid, the air should be pumped out, and in this "vacuum position" the balloon should be pre-tensioned so as to inflate itself upon releasing said vacuum. One way of providing a self-inflating balloon could be to manufacture it of a sponge-like material.

In FIG. 12, the back volume of the tube is used as extra back volume for the receiver. A hole (not shown) is provided in the receiver so as to connect the receiver back volume to the volume of the tube. The tube is closed in the end opposite to the receiver by a membrane. In FIG. 13, the balloon is filled with foam.

In FIG. 14, the receiver comprises a moving coil (instead of a regular receiver) positioned in the inflatable balloon.

FIG. 15 shows an arrangement where a ring of soft material is put around the balloon. The soft ring may provide an even softer and painless mounting of the receiver module in the ear canal than the embodiments shown in the previous figures.

In FIG. 16, the balloon is opened with an "umbrella-like" system so as to open the balloon mechanically. The umbrella is opened when pushing the rod E inwardly towards the receiver so as to push the soft material towards the ear wall. Pulling the rod E outwardly closes the umbrella.

FIG. 17 shows the present invention in combination with a BTE hearing aid. The receiver module is positioned within the bony area of the ear canal whereas the BTE hearing aid is outside the ear canal. The receiver module and the BTE hearing aid are connected via an extended tube section and a socket. Thus, the two parts can be easily separated in case that should be required.

FIG. 18 shows the present invention in combination with an ITE hearing aid. Again, the receiver module is positioned within the bony area of the ear canal whereas the ITE hearing aid is positioned in the soft area of the ear canal. The receiver module and the ITE hearing aid are connected via a tube section and a socket whereby the two parts can be easily separated. The concept of FIG. 18 also applies for ITC and CIC hearing aids.

It is a common feature of the combinations of FIGS. 17 and 18 that they both offer a huge adaptability. The user of the receiver module takes advantage of this adaptability in that the balloon/flexible member continuously adapts its shape to the ear canal—for example in the situation where the ear canal changes due to ageing.

In general it should be mentioned that the present invention may be applied in connection with all types of known hearing aid systems, such as BTE, ITE, ITC and CIC. Thus, variations and modifications of the disclosed embodiments may be implemented by a skilled person in the art without departing from the spirit and scope of the present invention.

The invention claimed is:

1. A receiver module being adapted to be positioned in an ear canal, the receiver module comprising a receiver having a receiver housing, said receiver being adapted to receive a time dependent electrical signal, said receiver further being adapted to generate outgoing acoustic waves via an output port in the receiver housing in response to the received time dependent electrical signal, expansible means comprising inflatable means, the expansible means surrounding at least part of the receiver housing, said expansible means having an opening aligned with the output port of the receiver housing so as to allow the generated outgoing acoustic waves to penetrate away from the receiver module and into the ear canal, and a tube section having first and second end parts, the first end part being connected to the inflatable means and/or to the receiver housing, said tube section being adapted to provide to the inflatable means a medium, said medium being adapted to inflate the inflatable means, wherein the receiver acts as a pump for providing the medium into the inflatable means so as to inflate the inflatable means.

2. A receiver module according to claim 1, wherein the tube section comprises a hollow inner section, said hollow inner section being adapted to support electrical means for providing the time dependent electrical signal to the receiver.

3. A receiver module according to claim 1, further comprising a filter positioned across the opening of the expansible means so as to cover the output port of the receiver housing.

4. A receiver module according to claim 1, further comprising a membrane positioned across the opening of the expansible means so as to cover the output port of the receiver housing.

5. A receiver module according to claim 1, further comprising a vent canal, said vent canal forming part of the inflatable means and the tube section so as to establish an unbroken vent canal from the second end part of the tube section to a point adjacent to the opening of the inflatable means.

6. A receiver module according to claim 1, wherein the second end part of the tube section is connected to a connection terminal, said connection terminal having electrical contacts connected to electrical means for providing the time dependent electrical signal to the receiver.

7. A receiver module according to claim 1, wherein the medium to inflate the inflatable means is air.

8. A receiver module according to claim 1, wherein the medium to inflate the inflatable means is a gel.

9. A receiver module according to claim 1, wherein the medium to inflate the inflatable means is a foam.

10. A receiver module according to claim 1, wherein the medium to inflate the inflatable means is a liquid.

11. A receiver module according to claim 1, wherein the receiver is connected to the inflatable means so that a back volume of the receiver inflates the inflatable means.

12. A receiver according to claim 1, further comprising a layer of soft and flexible material surrounding the expansible means.

13. A receiver according to claim 1, wherein the expansible means, in a cross-sectional profile, takes an elliptically shaped profile.

14. A hearing aid comprising a receiver module according to claim 1.

15. A hearing aid according to claim 14, wherein the hearing aid is selected from the group hearing aids consisting of Behind-The-Ear (BTE), In-The-Ear(ITE), In-The-Canal (ITC) or Complete-In-Canal (CIC).

* * * * *

UNITED STATES PATENT AND TRADEMARK OFFICE

CERTIFICATE OF CORRECTION

PATENT NO. : 7,227,968 B2
APPLICATION NO. : 10/177140
DATED : June 5, 2007
INVENTOR(S) : Aart Zeger van Halleren et al.

It is certified that error appears in the above-identified patent and that said Letters Patent is hereby corrected as shown below:

On Title Page item 54 and Col. 1, Line 1

Please amend the title to read:

EXPANSIBLE RECEIVER MODULE

Please amend the Related Application Data to read:

Related U.S. Application Data

Item (60) Provisional application No. 60/344,474, filed on Jun. 25, 2001. Provisional application No. 60/344,474, filed on Nov. 9, 2001.

Signed and Sealed this

Fourth Day of December, 2007

JON W. DUDAS
*Director of the United States Patent and Trademark Office*

UNITED STATES PATENT AND TRADEMARK OFFICE

CERTIFICATE OF CORRECTION

PATENT NO. : 7,227,968 B2
APPLICATION NO. : 10/177140
DATED : June 5, 2007
INVENTOR(S) : Aart Zeger van Halleren et al.

It is certified that error appears in the above-identified patent and that said Letters Patent is hereby corrected as shown below:

On Title page

Please amend the Related Application Data to read:

Related U.S. Application Data should read item
--(60) Provisional application No. 60/300,052, filed on June 25, 2001.
Provisional application No. 60/344,474, filed on November 9, 2001.--

Signed and Sealed this

Eighth Day of April, 2008

JON W. DUDAS
*Director of the United States Patent and Trademark Office*